United States Patent [19]

Proud et al.

[11] 4,358,641

[45] Nov. 9, 1982

[54] HIGH VOLTAGE CONTROL DEVICES

[75] Inventors: Joseph M. Proud, Wellesley Hills; James J. Auborn, Groton, both of Mass.; Richard A. Bessett, Derry, N.H.

[73] Assignee: GTE Laboratories Incorporated, Waltham, Mass.

[21] Appl. No.: 174,082

[22] Filed: Jul. 31, 1980

Related U.S. Application Data

[62] Division of Ser. No. 936,971, Aug. 25, 1978, which is a division of Ser. No. 661,677, Feb. 26, 1976, Pat. No. 4,185,206.

[51] Int. Cl.[3] ..... G01S 15/00

[52] U.S. Cl. ..... 179/113; 179/138

[58] Field of Search ..... 307/117; 337/1, 14, 337/21, 331; 200/150 R, 150 A, 182, 232; 361/433, 435, 10, 11; 179/113, 138

[56] References Cited

U.S. PATENT DOCUMENTS

| | | | |
|---|---|---|---|
| 1,863,253 | 6/1932 | Polin | 337/21 X |
| 2,802,157 | 8/1957 | Kordesch et al. | 337/14 X |
| 3,522,472 | 8/1970 | Breitholtz | 361/10 X |

OTHER PUBLICATIONS

Steunenberg et al. "Electrical Conductivity of Liquid Sulfur and Sulfur-Phosphorous Mixtures", Sulfur Research Trends; pp. 190–200, American Chemical Society, Feb. 1971.

*Primary Examiner*—G. Z. Rubinson
*Assistant Examiner*—James L. Dwyer
*Attorney, Agent, or Firm*—Fred Fisher

[57] ABSTRACT

High voltage control devices are provided comprising a housing, an aprotic liquid contained within said housing, means for effecting heat exchange with said liquid, at least two spaced electrodes contained within said liquid and each of said electrodes extending from said housing. These devices find utility as variable resistors, circuit breakers, theremostats, optical triggering devices, acoustic pulse generators and the like.

4 Claims, 7 Drawing Figures

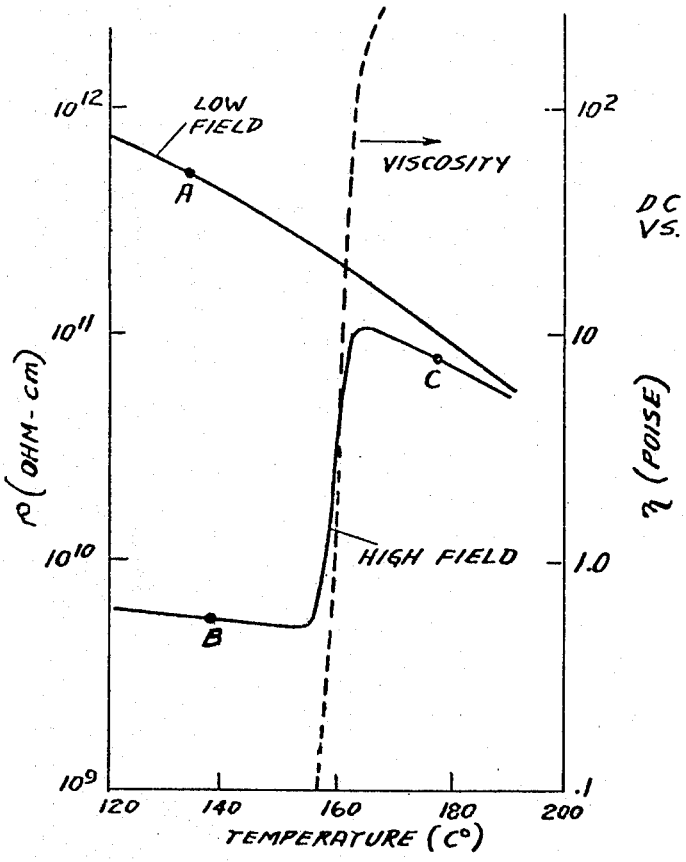
Fig. 1.
DC RESISTIVITY AND VISCOSITY VS. TEMPERATURE (C°) FOR MOLTEN SULFUR
Fig. 2.
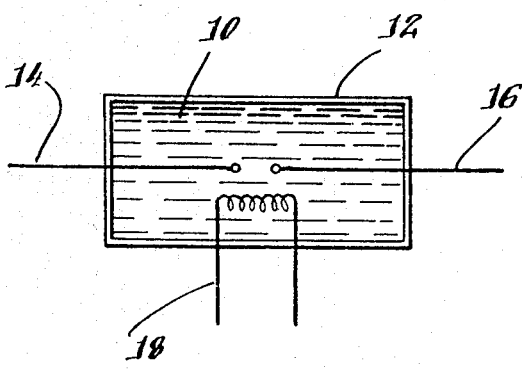
Fig. 3.
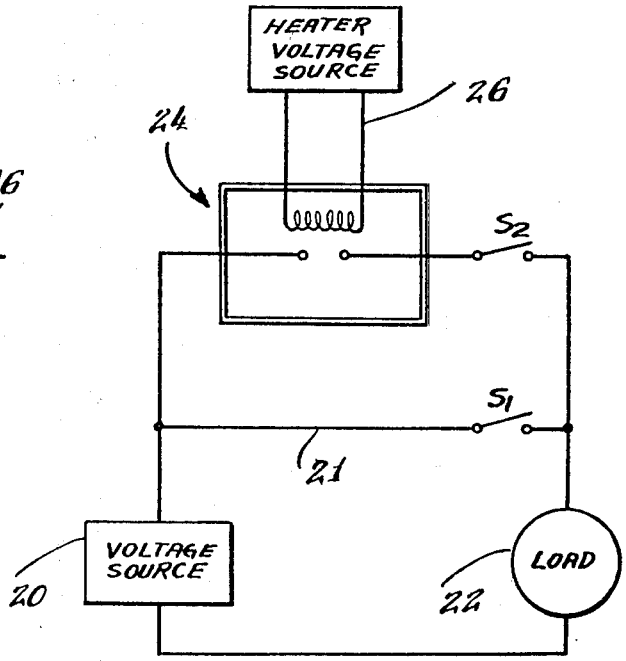

HIGH VOLTAGE CONTROL DEVICES

The invention herein described was made in the course of or under a contract or subcontract thereunder with the U.S. Navy.

This is a division of application Ser. No. 936,971, filed Aug. 25, 1978, which, in turn is a division of application Ser. No. 661,677, filed Feb. 26, 1976, now U.S. Pat. No. 4,185,206, issued Jan. 22, 1980.

This invention relates to a high voltage control device. More particularly, this invention relates to the use of certain aprotic liquids in high voltage control devices.

The present invention provides high voltage control devices which utilize the unique physical properties of molten sulfur, sulfur monochloride and mixtures thereof. For example, molten sulfur exhibits an anomalous variation of electrical resistance with temperature under high voltage conditions enabling its use as a variable resistance-type control device. Molten sulfur, sulfur monochloride and mixtures thereof do not generate bubbles or undergo degradation under spark discharge conditions enabling the obtainment of highly stable control devices useful over extended periods of time. Moreover, molten sulfur and sulfur monochloride are photoconductive, thereby providing a convenient trigger mechanism for such devices.

It is an object of this invention to provide devices for current control under high voltage conditions.

It is another object of this invention to provide a high voltage control device which does not undergo decomposition when subject to an arc discharge. Moreover, said control device does not require purification or maintenance to preserve its operability over extended periods.

It is still another object of this invention to provide a high voltage control device which can be used as a thermal switch thereby enabling its use as a thermostat, circuit breaker, variable resistor and the like.

It is a further object of this invention to provide a high voltage control device with photoconductive capabilities for control of current and even the initiation of electrical breakdown of the medium. Sparking within a device containing such aprotic liquids, when coupled to an acoustic matching medium, provides an excellent acoustic pulse source.

These as well as other objects are accomplished by the present invention which provide a high voltage control device comprising a housing, an aprotic liquid contained within said housing, means for effecting heat exchange with said liquid, at least two spaced electrodes contained within said liquid and each of said electrodes extending from said housing.

FIG. 1 is a graphical representation illustrating the effect of variations in temperature upon the resistivity and viscosity of molten sulfur;

FIG. 2 is a schematic representation of one embodiment of a high voltage control device in accordance with the present invention;

FIG. 3 is a circuit diagram illustrating the use of the high voltage control device of the present invention as a variable resistor;

Figure 4:
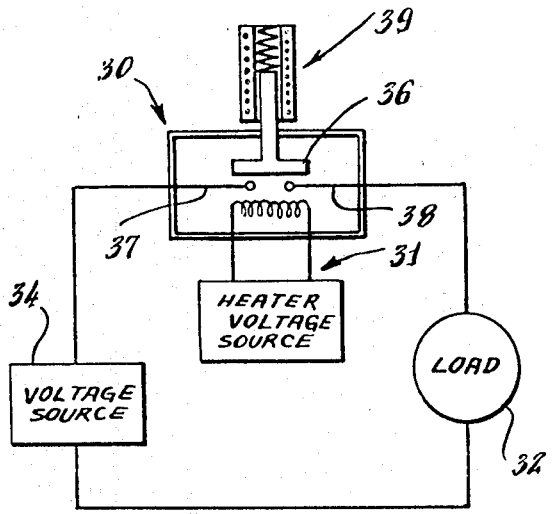
FIG. 4 is a circuit diagram illustrating the use of the high voltage control device of the present invention as a circuit breaker.

Aprotic liquids are molecular liquids which neither yield protons to a solute nor accept protons from a solute. Generally, such liquids are characterized by the absence of C-H bonds. The aprotic liquids useful in the present invention, unlike liquified noble gases or liquified metals, are highly insulating liquids over a wide useful and conveniently obtained temperature range, e.g., sulfur: 112.8° C. to 444.6° C.; sulfur monochloride ($S_2Cl_2$): −80° C. to 135.6° C. Mixtures of sulfur and sulfur monochloride can be similarly employed in widely varying volumetric ratios, e.g., sulfur: sulfur monochloride 1:99 to 99:1.

Molten sulfur is particularly preferred for use as a high voltage insulating medium in accordance with the present invention. As indicated above, molten sulfur exhibits a wide liquid range and a large viscosity increase at 159° C. owing to the opening of molecular $S_8$ rings and polymerization to form long chain molecules at the higher temperatures. The low conductivity of molten sulfur ($10^{-12}$ ohm$^{-1}$ cm$^{-1}$) and the absence of decomposition, even under spark discharge conditions, contributes materially to the use of molten sulfur as a high voltage insulating medium. The breakdown strength of molten sulfur is above $10^6$ V/cm.

Another aprotic molecular liquid useful in the present invention is sulfur monochloride, $S_2Cl_2$. Although this liquid is less stable chemically than pure sulfur and has a higher conductivity ($10^{-9}$ ohm$^{-1}$ cm$^{-1}$), it provides a wide useful liquid range (−80° to 138° C.) about ambient temperature. The dielectric strength of $S_2Cl_2$ is in excess of $10^6$ V/cm.

Referring now to FIG. 1, there is shown the resistance-temperature dependence at high and low fields for molten sulfur which provides an effective thermal switching effect at temperatures surrounding the viscosity transition at 159° C. At low fields, the resistance decreases with increasing temperature according to the usual exponential dependence characteristic of semiconductors. Below the viscosity transition temperature (159° C.), a high voltage control device of the type shown in FIG. 2 (discussed hereinafter) normally operating under low field conditions (point A) will, if a high field is impressed, decrease markedly in resistance (point B). Typically, the resistance at point B is only 2–10% of the value at point A. Raising the temperature of the molten sulfur causes the resistance to increase to point (C). Typically, this is a 10 to 20-fold increase in resistance over a 5° C. range. The use of the viscosity transition as compared to a phase transition is advantageous in that there is little expansion or contraction of the material upon crossing the viscosity transition temperature and the material is liquid in both states, thus conforming to the containing vessel and the electrical contacts. The viscosity transition is reversible so that many cycles of operation can be effected. While the resistivity of molten sulfur is relatively high, doping of the molten sulfur with halogens such as chlorine or iodine can provide a means for lowering or otherwise altering the resistance-temperature profile.

The present invention employs this anomalous variation of electrical resistance with temperature associated with molten sulfur to provide a high voltage control device, one embodiment of which is shown in FIG. 2. The molten sulfur 10 is contained within a housing 12. Two spaced electrodes 14 and 16 are immersed in the molten sulfur within the housing with portions of said electrodes extending outside of the housing to serve as leads to and from the device. Means for effecting heat exchange with the molten sulfur, such as immersion heater 18, are situated in heat exchange contact with the molten sulfur to maintain the molten sulfur within the liquid temperature range and to provide a means for selectively altering the temperature of the molten sulfur to take advantage of its resistance-temperature dependence. Heat exchange also can be effected by immersing the device shown in FIG. 2 in a heating bath such as an oil bath, fluidized sand bath and the like.

The high voltage control device of the present invention finds utility as a variable resistor which can be employed, for example, in the fault current limiting circuit shown in FIG. 3. The voltage source 20 normally feeds the load 22 through a power bus 21 containing circuit breaker $S_1$ which is normally closed. The parallel circuit containing the high voltage control device 24 of the present invention and normally closed circuit breaker $S_2$ carries only a small fraction of the total current. Thus, in the "normal" mode, control device 24 operates as indicated by point A in FIG. 1. When a fault occurs such as a short circuit across part or all of load 22, the breaker $S_1$ will open creating an open circuit in the power bus 21. This action is made easier by the fact that the parallel path exists containing control device 24 and circuit breaker $S_2$. Upon the sudden increase in voltage across the control device 24, the resistance of the device immediately decreases in value (as shown by point B in FIG. 1). This sudden decrease in resistance tends to eliminate large voltage transients due to inductive effects and further eases the opening of breaker $S_1$. At this point, breaker $S_2$ carries the fault current limited by the resistance of the control device 24. Until the fault has been located and cured, it becomes desirable to open breaker $S_2$ thereby fully interrupting the circuit between source 20 and load 22. The fault current is generally a large current and one which would be difficult to interrupt without arcing in conventional circuit breakers. It is therefore preferable that the resistance of the control device 24 undergo a transition to a larger value in advance of the opening of breaker $S_2$ (point C in FIG. 1). This "soft" switching effect can be conveniently effected by control device 24 either automatically by the temperature change generated by the internal heating effect of the high current or by activation of heating means 26. Depending upon the magnitude of the currents involved, the internal heating effect of the high current may produce this "soft" switching effect even before the fault is cured. Once the resistance is raised to the desired level, breaker $S_2$ can be conveniently opened.

Many materials, metals in particular, possess positive temperature coefficients but of such small value that the desired resistance change is produced too slowly. To speed the resistance change, some success has been achieved with solid-liquid phase transitions of metals such as sodium. Certain hazards exist in using this material and it is difficult to maintain the integrity of the material for re-use after it has re-crystallized. In accordance with the present invention, however, a control device employing molten sulfur enables a 10 to 20-fold variation in resistance to be effected over a very narrow temperature range, e.g., about 5° C.

Present methods for current interruption involve the rapid separation of current contacts in a medium which must rapidly quench the arc discharge formed when such contacts are opened and which must rapidly recover preparatory to additional interruptions should that be necessary. Present methods utilize air, $SF_6$, hydrocarbon oils and the like as the insulating medium. Operation of the circuit breaker seriously decomposes these media making it necessary to service the breaker, i.e. the change or purify the medium, or requires provision for continuous flow to rid the vessel surrounding the contacts of decomposition products.

Bubble generation has heretofore been an integral part of electrical breakdown in known insulating fluids. As gas bubbles containing decomposition products persist for long periods of time, the electrical strength of the medium is accordingly degraded. Solid decomposition products such as free carbon are also formed in typical insulating (hydrocarbon) liquids. These materials must be removed to restore the integrity of the breaker for further use.

Gases such as air or $SF_6$ are commonly used as breaker media. While these gases do not form suspended particulates or persistent dielectric discontinuities, their decomposition products may be very troublesome chemically, e.g., the formation of nitric acid in air discharges with water vapor present. The electrical breakdown strength of these gases is much less than that of typical liquid insulators. Thus, for breaker applications at high voltage such as is used by the power industry, very highly compressed gases must be used. The noble gases such as argon are not used since they are very poor electrical insulators, and since they are not electron attaching, they do not quench electrons from the discharge.

The high voltage control device of the present invention employing molten sulfur, sulfur monochloride and mixtures thereof as the insulating medium provides an excellent switching medium for circuit breakdown which does not decompose when subjected to an arc discharge and which provides a high resistance to current flow immediately before and after such discharges. Moreover, these switching media do not require purification or maintenance to preserve their function over many operations of the breaker.

Thus, a spark discharge in these aprotic liquids produces no contamination, either gaseous or solid. Moreover, these liquids are excellent insulators, possessing high electrical resistivities and breakdown strengths. Thus, the use of the high voltage control device of the present invention in circuit breaking applications provides significant advantages over the materials heretofore employed since it would not require frequent service. Thermal insulation requirements are minimal owing to the relatively low operating temperature (−80°–440° C. range) and the highly insulating properties of the liquids themselves.

Referring now to FIG. 4, a typical circuit utilizing the high voltage control device 30 of the present invention as a circuit breaker is shown. The load 32 is powered by voltage source 34, both of which are in series with control device 30. When an overload occurs and/or sudden current interruption is desired, the bridging contact 36 can be withdrawn from electrical contact with the spaced electrodes 37 and 38 either manually, via a solenoid 39 (as shown), or by other conventional circuit breaking techniques thereby creating an open circuit. The temperature of the aprotic liquid can be controlled by heating means 31. If desired, the required heating to maintain the aprotic liquid in the liquid phase can be accomplished by bleeding a small current from the voltage source and utilizing an immersion heater technique.

Figure 5:
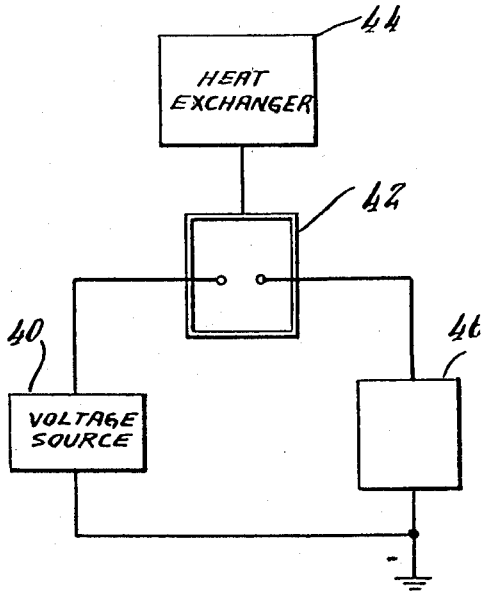
FIG. 5 is a circuit diagram illustrating the use of the high voltage control device as a thermostatic device.

The high voltage control device of the present invention also provides a unique temperature sensing device which can function as a thermostat, a heat sensor adapted to activate alarm systems and the like. FIG. 5 illustrates the use of the high voltage control device of the present invention as a thermal switch to activate a system or device. Thus, in the "off" mode, the voltage source 40 imposes a high voltage drop across control device 42. The temperature of the control device is regulated by heat exchange means 44 such that the control device exhibits a high resistance (e.g., point C in FIG. 1). When it is desired to activate the system 46 or when a temperature is reached which requires the system to be activated, the resulting temperature drop either effected by heat exchange means 44 or by the temperature conditions of the surrounding environment causes a significant drop in resistance (e.g., a drop to point B in FIG. 1) with a corresponding increase in current thereby activating the system. Conversely, an increase in temperature permits a return to point C in FIG. 1 with corresponding inactivation of the system.

The high voltage control device of the present invention is also suitable for use in microwave transmission devices.

In microwave power applications, it is of interest to operate switches which can insulate against voltages as high as 50 KV but which can close upon command to a very low impedance value within about $10^{-11}$ to $10^{-9}$ seconds, with accordingly small jitter. Solid state devices are generally not capable of these high operating voltages, nor of the high discharge currents which flow when the switch is closed. High pressure gas switches are useful for these purposes but a satisfactory low jitter trigger has not, as yet, been found. Liquid dielectric switches have many desired features such as high dielectric strength, affording close gap spacing at high operating voltages that minimize self-inductance when the discharge is formed. A basic difficulty with liquid dielectric spark devices has been the formation of bubbles during breakdown thus preventing repetitive function. Moreover, such bubbles are the result of decomposition of the liquid medium. Suitable triggering means have been generally unavailable in liquids which can produce low jitter performance.

It has now been found that discharges in molten sulfur, sulfur monochloride and mixtures thereof produce no bubbles, a behavior previously unknown in liquids. It has also been found that these aprotic liquids are photoconductive, thus producing free electrons when illuminated with a suitable light source. Preconditioning of the liquid is therefore possible when a high field is applied that is not quite sufficient for breakdown, typically 500 kilovolts/cm. Under these conditions, the appearance of phot-induced free electrons will cause rapid electrical breakdown in the medium.

A particularly valuable feature of the photoconduction triggering method is associated with the use of an optical path for the triggering signal. This permits the triggering of single or multiple switches carrying very high potentials where direct connection would prove hazardous. Optical triggering also obviates the use of structures such as triggering pins, grids and screens. For this reason, reliability and durability of the switch are high while cost is relatively low.

Figure 6:
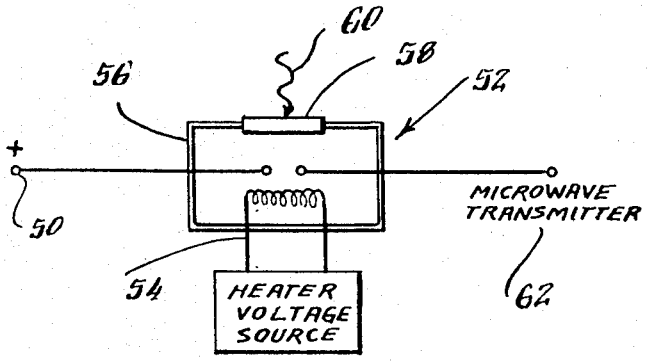
FIG. 6 is a schematic representation of another embodiment of the high voltage control device used as a high voltage switch.

FIG. 6 illustrates another embodiment of the high voltage control device of the present invention adapted for photoconductive triggering of the spark gap formed by the spaced electrodes. It should be emphasized, however, that although photoconductive triggering is illustrated, other triggering devices (such as an electron injecting third electrode or most conveniently, simply exceeding the breakdown potential by regulation of the voltage source) can be similarly employed. In the pre-triggered state, an electric field from voltage source 50 is applied across the control device 52 at a potential below the breakdown field strength of the aprotic liquid. Under these conditions, only a small dark current flows. The aprotic liquid contained within the control device 52 is maintained in the liquid state by heat exchange means 54. It is important when using molten sulfur to regulate the temperature of the molten sulfur under such high field conditions to maintain the resistance of the molten sulfur at a relatively low value, e.g., such as point B in FIG. 1. The housing 56 of the control device 52 can contain an optically transparent window 58 through which the aprotic liquid can be exposed to a light pulse 60. When a light pulse is applied which has an appropriate spectral output (e.g., about 3000 to 6000 Å), photo-induced, relatively mobile charge carriers are produced throughout the bulk liquid occupying the high field region. The result is the rapid reduction of the dielectric strength and the onset of an avalance breakdown. The removal of the light and the collapse of the field across the gap results in the rapid recovery of the pre-triggered breakdown value. It has been found that recovery in such devices of the present invention is complete in about 10 μsec. The resulting current pulse is fed to a microwave transmitting device 62.

As described above, the high voltage control device of the present invention provides a means for accurately controlling the initiation time of an electrical discharge between spaced electrodes in a liquid medium. The thermal expansion caused by the electrical discharge in the liquid medium produces a pressure pulse characterized by a steep shock front which decays smoothly due to thermal diffusion in the liquid. As described herein, discharges in the aprotic liquids of the present invention produce no bubbles, a phenomenon previously unknown in liquids. Owing to this absence of bubbles, the pressure pulse is free of undesirable oscillations. Also, high repetition rates can be achieved since no bubble clearing time is required.

These factors enable the high voltage control device of the present invention to function as an acoustic pulse generator which does not produce undesirable oscillations or noise in the post-pulse period while affording a high repetition rate, high power pulse generation capability. Such a source may be of great usefulness in ranging work such as: sonar, geophysical exploration, depth sounding and biological scanning. A quite post-pulse period permits reception of return echoes at short range and unambiguous interpretation of return pulse shapes.

Acoustic pulses for the above purposes are presently generated by explosive charges, hammer blows, piezoelectric devices, magnetostrictive devices or spark discharges (in water). The electro-mechanical devices find wide use in sonar and other communication applications in the sea. In some cases, these techniques suffer from the relatively low excess pressure which can be generated. Explosive charges and spark discharges in sea water result in bubbles which may confuse the acoustic signal or cause it to persist for long periods after the pulse is generated. Moreover, these sources are generally limited to very low repetition rates.

Figure 7:
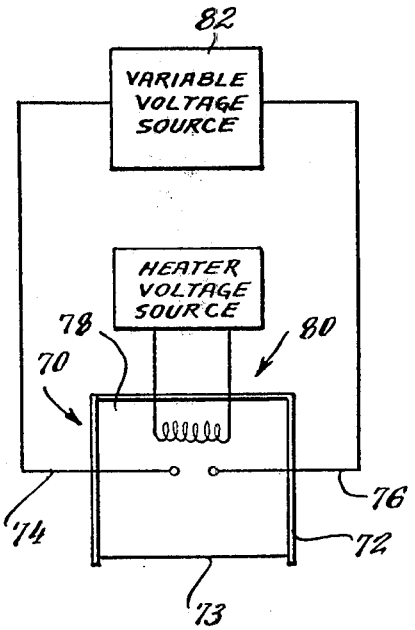
FIG. 7 is a circuit diagram illustrating the use of the high voltage control device as an acoustic pulse generator.

FIG. 7 illustrates another embodiment of the high voltage control device of the present invention modified to function as an acoustic pulse generator. In this instance, the control device 70 comprises an acoustically transparent housing 72, at least one wall of which is a flexible membrane 73 adapted to transmit the generated acoustic pulse from the aprotic liquid to another liquid of substantially matching impedance, e.g., water. The housing 72 contains a pair of spaced electrodes 74 and 76 immersed in the aprotic liquid 78, i.e., molten sulfur, sulfur monochloride or mixtures thereof. A heater 80 is employed to maintain the aprotic liquid in the liquid phase. A variable voltage source 82 is connected across the device to initiate sparking across the electrode gap. Alternatively, an optically transparent window (not shown) can be included within the housing and sparking can be initiated photoelectrically as discussed above in connection with FIG. 6.

The high voltage control device of the present invention is uniquely suited as an acoustic pulse generator. The pressure pulse produced by the thermal expansion caused by the electrical discharge in the aprotic liquid medium generates a steep shock front which is coupled with a smooth decay brought about by thermal diffusion. Oscillations do not exist due to the absence of bubbles. Additionally, high repetition rates can be achieved since no bubble clearing time is required. The ability to generate an acoustic pulse without accompanying bubble generation is of critical importance since bubbles confuse the acoustic signal and can cause it to persist long after it is generated.

The high voltage control device of the present invention has thusfar been illustrated primarily as a two electrode device. If desired, a third electrode can be included within the housing to serve as a cleanup electrode which could electrophoretically attract foreign particles in the liquid medium.

Although specific materials, devices, circuits and conditions are set forth herein to illustrate the fabrication and use of the high voltage control devices of the present invention, these are merely intended as illustrations of the present invention. Various other liquids, control devices, and circuits may be substituted herein with similar results.

Other modifications of the present invention enabling other control devices and circuits embodying the principles of the present invention will occur to those skilled in the art upon a reading of the present disclosure. These are intended to be included within the scope of this invention.

What is claimed is:

1. An acoustic pulse generator comprising an acoustically transparent housing, an aprotic liquid contained within said housing, means for effecting heat exchange with said liquid, at least two spaced electrodes contained within said liquid and each of said electrodes extending from said housing, a matching medium coupled to said housing, means for generating a spark across the spaced electrodes to produce a pressure pulse in the aprotic liquid and means for transmitting the pulse from the liquid to the matching medium.

2. An acoustic pulse generator as defined in claim 1 wherein the spark generating means comprises a variable voltage source capable of producing a field exceeding the breakdown field.

3. An acoustic pulse generator as defined in claim 1 wherein at least one wall of the housing is a flexible membrane adapted to transmit the generated pressure pulse from the aprotic liquid to the matching medium.

4. An acoustic pulse generator as defined in claim 1 wherein at least a portion of the housing is optically transparent and the spark generating means comprises a voltage source for establishing a field having a magnitude below the breakdown field magnitude and means for applying a controlled light pulse to the optically transparent portion of the housing.

* * * * *